US006267687B1

(12) United States Patent
Alex

(10) Patent No.: US 6,267,687 B1
(45) Date of Patent: Jul. 31, 2001

(54) GOLF CALCULATOR

(76) Inventor: Emil Alex, 305, 3131-63 Avenue S.W., Calgary, Alberta (CA), T3E 6N4

( * ) Notice: Subject to any disclaimer, the term of this patent is extended or adjusted under 35 U.S.C. 154(b) by 0 days.

(21) Appl. No.: 09/357,118

(22) Filed: Jul. 19, 1999

(51) Int. Cl.[7] ..... A63F 9/22
(52) U.S. Cl. ..... 473/131; 700/91
(58) Field of Search ..... 473/131, 407, 473/409; 700/91–92; 340/323 R; 235/375, 1 B, 419; 273/459–460, DIG. 26

(56) References Cited

U.S. PATENT DOCUMENTS

D. 322,450 12/1991 Smith, Sr. ..... D18/6
5,536,010 * 7/1996 Lambourne ..... 700/91
6,162,129 * 12/2000 Nielsen ..... 473/131

OTHER PUBLICATIONS

Powermark advertisement.

* cited by examiner

*Primary Examiner*—Mark Sager
(74) *Attorney, Agent, or Firm*—David S. Thompson

(57) ABSTRACT

A golf calculator 10 provides a microcontroller-based circuit comprising a ROM 30 (read-only memory), a RAM 40 (random assess memory), a keypad 50, an LCD (liquid crystal display) or similar display 60 within an enclosure 70. The microcontroller 20 executes software permanently stored in the ROM which allows the determination of a number of statistics, including the handicap index, the handicap, a data element related to the golfer's consistency, the highest score, the lowest score, the average game and puts per game. Software routines also maintain a database of records, each record containing the game number, rank of the score of the game, date, score of the slope of the course, the course rating and the number of putts in a record associated with each game.

1 Claim, 4 Drawing Sheets

GOLF CALCULATOR

CROSS-REFERENCES

There are no applications related to this application filed in this or any foreign country.

BACKGROUND

It is either very inconvenient, or more likely, beyond the ability of most amateur golfers to calculate their golf handicap. The calculation involves a significant amount of arithmetic and record keeping, and without some training, an electronic calculator and some time and effort many golfers would not be able to arrive at the correct answer.

Additional confusion is introduced when a player uses more that one golf course. The differences between golf courses in the course slope and course rating statistics results in additional confusion for most golfers. As a result, these factors are not typically taken into account, resulting in considerable inaccuracy in the calculation if made, and a lower likelihood that the calculation will be made where it is realized that the factors should be taken into account, but without the understanding of how they should be taken into account.

Still further confusion is introduced by the variety of methods of calculating handicap involving variations of the number of handicap differentials required to produce a handicap, and specifically which differentials should be used from among the available differentials.

As a result, most players only approximately or falsely calculate their handicap. Nevertheless, very few automated devices are available to aid the golfing public. The available devices have a number of flaws, including difficult data entry, failure to store sufficient data carrying over from prior games and failure to incorporate differentials derived from prior games. Moreover, known golf calculators fail to input, analyze and display peripheral data such as number of putts, highest score, lowest score and average game. Frequently, while handicap data is good for comparison to other golfers, it is the analysis of the peripheral data that provides actual benefit to the player's game.

A still further failure of known golf calculators is the lack of calculation and display of information related to the consistency of the golfer's game. Such data, based on standard deviation calculations, are important to provide the player with feed-back related to whether problems are chronic or sporadic. The consistency calculations and display are particularly important in a sport such as golf, where the ability to perform repeatedly at a consistent level is extremely important.

For the foregoing reasons, there is a need for a golf calculator that can perform handicap calculations, that can perform consistency calculations, which performs peripheral calculations such as the average game and which provides record-keeping functionality.

SUMMARY

The present invention is directed to an apparatus that satisfies the above needs. A novel golf calculator is disclosed that easily calculates and displays golf score handicaps, consistency statistics, peripheral data calculations and record-keeping functionality.

The golf calculator of the present invention provides some or all of the following structures.

(A) A microcontroller having appropriate random access memory and read-only memory for performing data input, data storage and statistical calculation functionality.

(B) Keypad input means, connected to the microcontroller, for transferring data to the microcontroller.

(C) A display, driven by the microcontroller, for outputting alpha-numeric data to the golfer.

(D) Software routines, carried in read-only memory and executed by the microcontroller, to support the calculation, arithmetic manipulation and/or display, of the handicap differential, the handicap index, the golfer's handicap, a consistency statistic and other functionality.

It is therefore a primary advantage of the present invention to provide a novel golf calculator which performs data input, statistic calculation and data output functionality, and particularly which provides a convenient means for a golfer to obtain handicap information.

Another advantage of the present invention is to provide a golf calculator which performs statistical calculations resulting in the output of data reflecting the consistency of the golfer's performance.

A still further advantage of the present invention is to provide a golf calculator which defines a user interface having distinctive characteristics which aid in the rapid input, manipulation and display of data.

DRAWINGS

These and other features, aspects, and advantages of the present invention will become better understood with regard to the following description, appended claims, and accompanying drawings where:

DESCRIPTION

Figure 1:
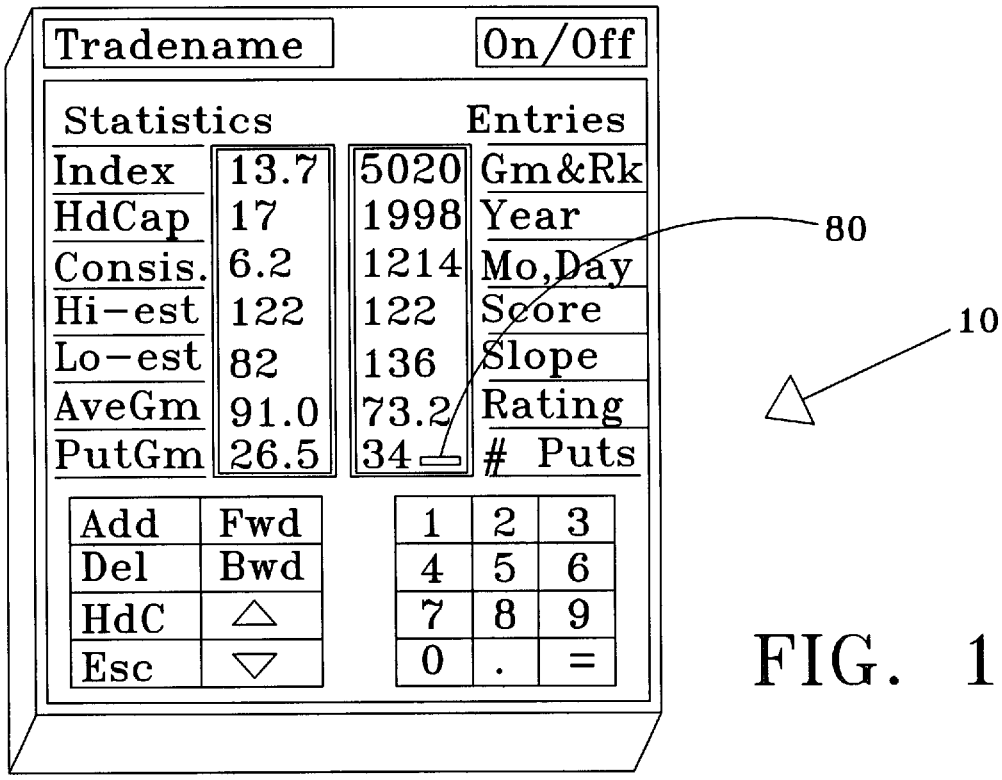
FIG. 1 is a perspective view of a preferred version of the golf calculator of the invention, having two LED displays, each having seven rows, each row capable of displaying at least four characters.
Figure 2:
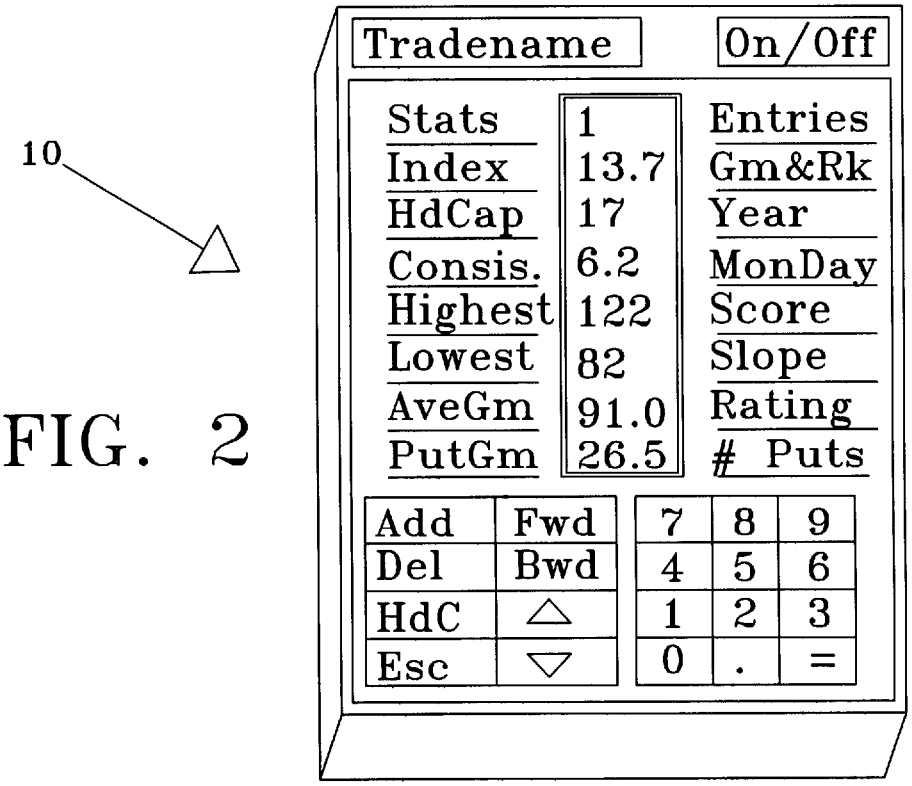
FIG. 2 is a perspective view of an additional version of the golf calculator having an LED display having eight rows, each row capable of displaying at least four characters.
Figure 3:
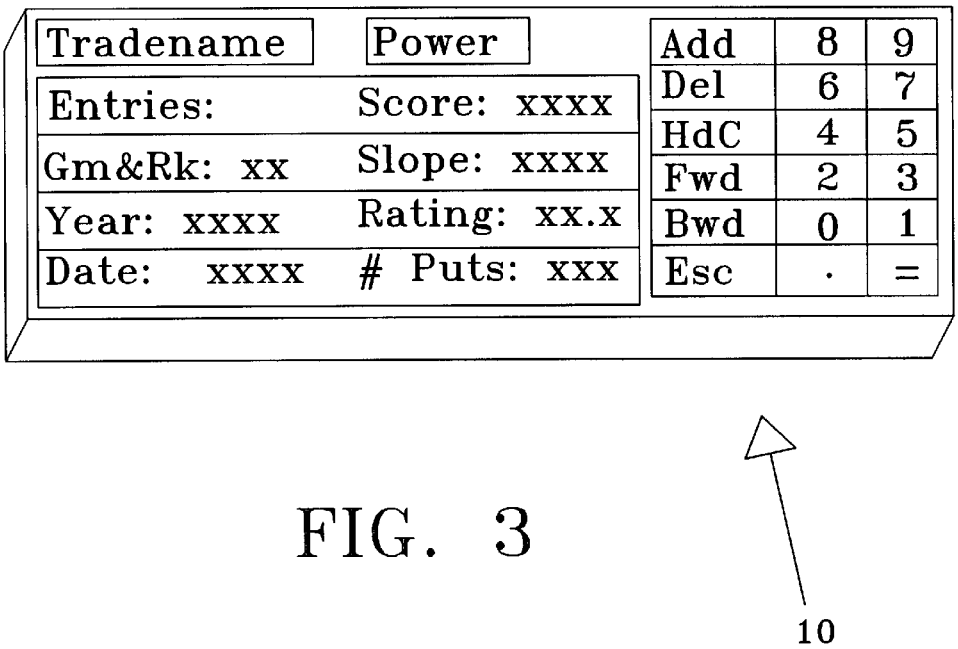
FIG. 3 is a perspective view of an additional version of the golf calculator having an LED display having four rows, each row capable of displaying at least twenty characters.
Figure 4:
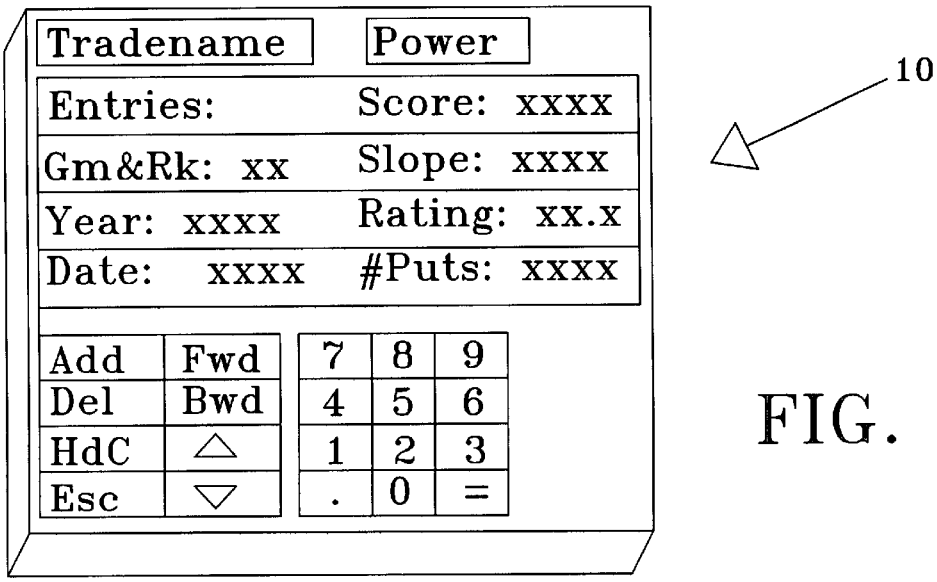
FIG. 4 is a further example of an additional version of the perspective view of a golf calculator having an LED display having four rows, each row capable of displaying at least twenty characters.
Figure 5:
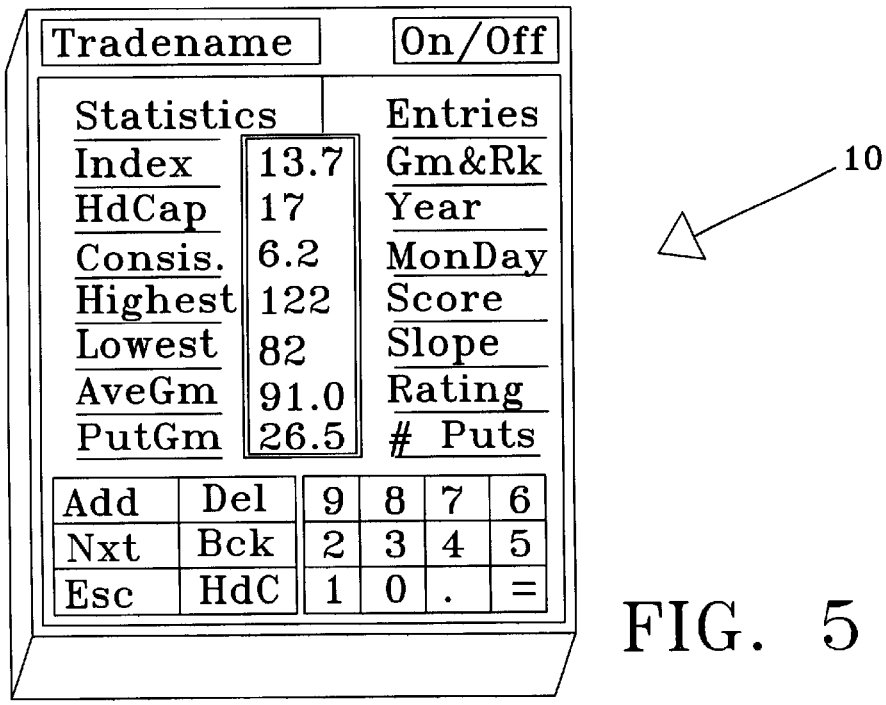
FIG. 5 is a further example of an additional version of the perspective view of a preferred golf calculator having two LED displays, each having seven rows, each row capable of displaying at least four characters.
Figure 6:
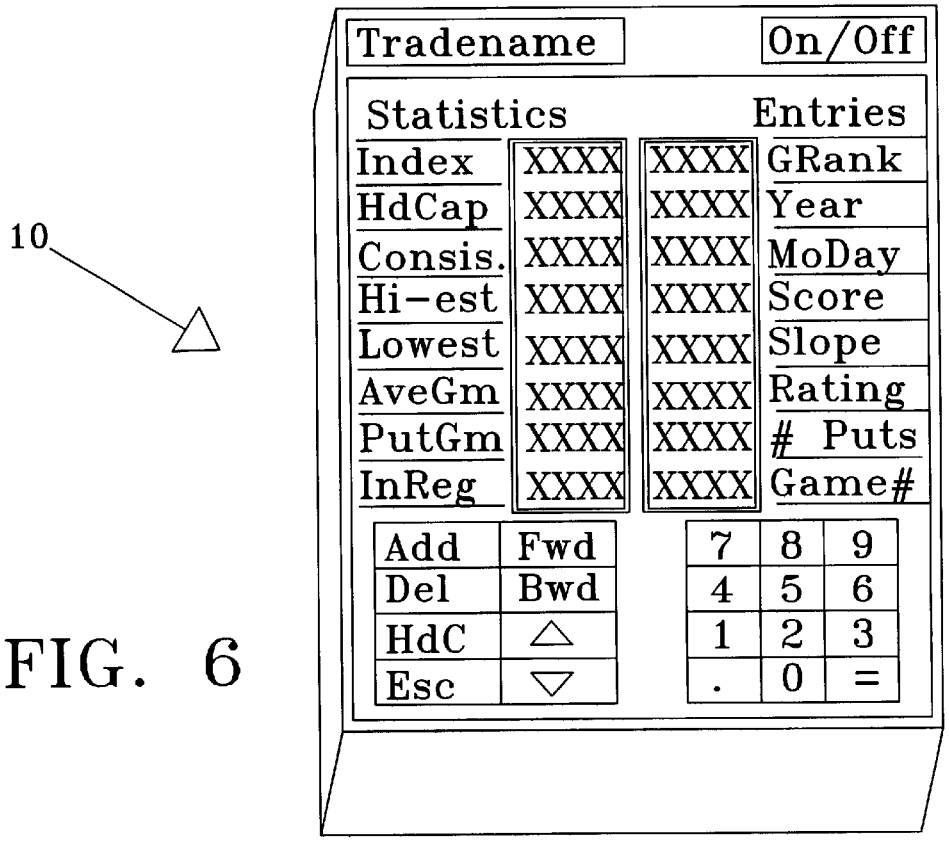
FIG. 6 is a perspective view of an additional version of the golf calculator having two LED displays, each having eight rows, each row capable of displaying at least four characters.

Referring in generally to FIGS. 1 through 7, a golf calculator 10 constructed in accordance with the principles of the invention is seen. A preferred calculator provides a microcontroller-based circuit comprising a ROM 30 (read-only memory), a RAM 40 (random assess memory), a keypad 50, an LCD (liquid crystal display) or similar display 60 within an enclosure 70. The microcontroller 20 executes software permanently stored in the ROM which allows the determination of a number of statistics, including the handicap index, the handicap, a data element related to the golfer's consistency, the highest score, the lowest score, the average game and puts per game. Software routines also maintain a database of records, each record containing the game number, rank of the score of the game, date, score of the slope of the course, the course rating and the number of putts in a record associated with each game.

Figure 7:
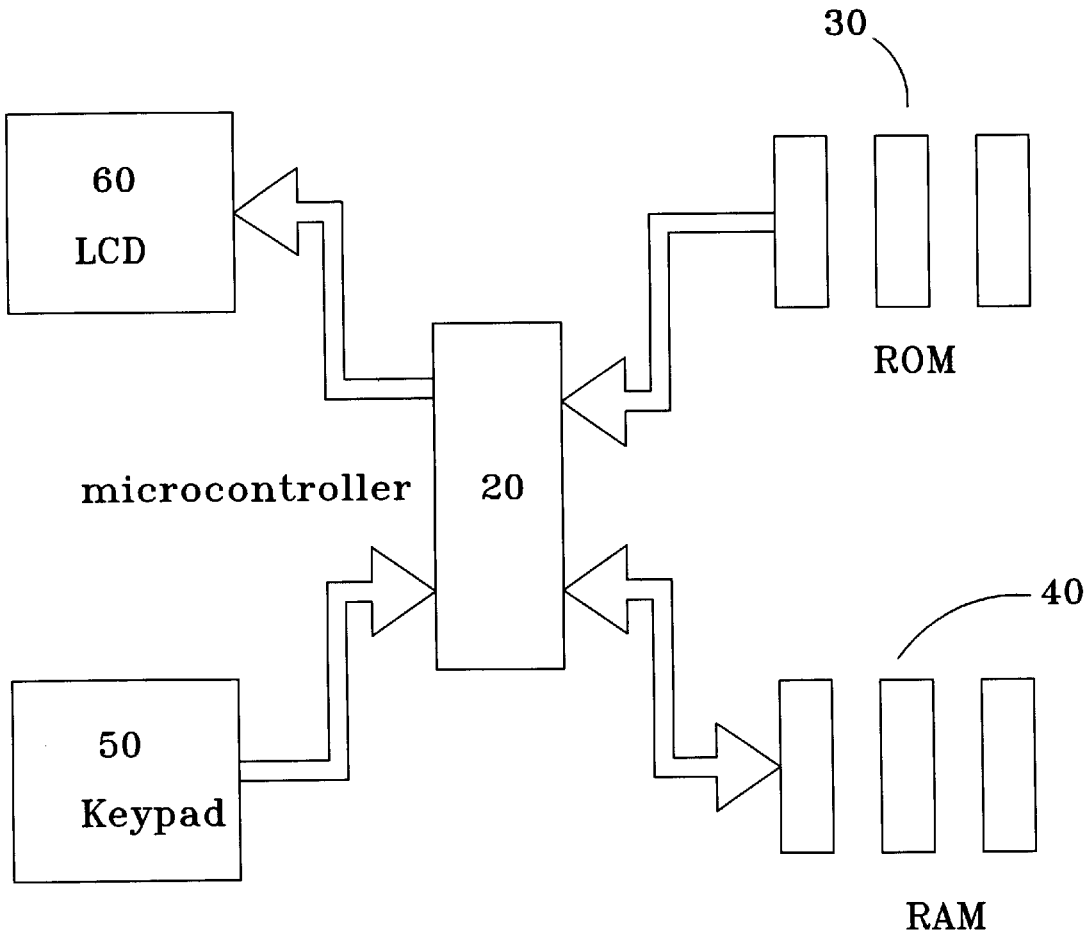
FIG. 7 is a diagrammatic view of the circuit supporting the functionality of the golf calculator of the invention.

Referring to FIG. 7, a diagrammatic view of a version of the circuit of a preferred golf calculator 10. The circuit is microcontroller-based, having a microcontroller 20 having sufficient ROM 30 to store a simple operating system and the application software, as described. Non-volatile RAM is used to store a database associated with the games played, and is used as a scratch pad during computations. When power is turned off, the RAM is of a type which retains the stored information. Lines from the keypad 50 are input to a port in the microcontroller, allowing data to be transferred to the microcontroller. Similarly, a second port of the microcontroller drives one or more LCD displays 60, or similar output device. A source of direct current such as a battery, typically having some voltage regulation, as is well-known.

A software routine creates a new record in RAM to be associated with a new golf game when the ADD key is pressed. A database, stored in non-volatile RAM, comprises a plurality of records, wherein each record is associated with a distinct golf game. Each record includes a number of fields within which information is stored. The number of records stored is limited by the size of RAM. When the limit of the RAM is reached, the software routine will delete the oldest record to make room for the newest record.

In response the pressing of the ADD key, a data input mode is entered. The display is updated to reflect the empty record. In particular, referring to FIG. 1, the Gm&Rk (game and rank) field, the year field, the month and day field, the score field, the slope field, the rating field and the number of putts fields become set to zero or blank. By using the up and down arrow keys, the user is able to move a cursor 80 between the fields. By using the number keys, the user is able to enter the information. By using the "=" key, the user confirms that the information is correct, prompting the software to copy that information to the record in the database.

The software routine then calculates values for the various fields displayed by the LCD and the handicap differential field, which is not displayed. The handicap differential is calculated by a handicap differential software routine by taking the gross score for the game and subtracting the course rating. As seen in FIG. 1, the gross score is 122 and the course rating is 73.2. The result is then multiplied by the fraction 113 over course slope. As seen in the example of FIG. 1, the course slope is 136. The result is usually rounded off to the nearest tenth.

The Index field displays the handicap index, which is a measure of a player's scoring ability on a golf course of standard playing difficulty. The index is expressed as a number, typically taken to one decimal place. The range limits for the handicap index are −3.5 to 36.4 for men and −3.5 to 40.4 for women.

To calculate the handicap index, a handicap index software routine first averages the lowest 10 handicap differentials found in the last 20 records. The average is then multiplied by 0.96. This number is then displayed in the index field. As seen in FIG. 1, the index is 13.7.

Where less than 5 records are available, the index and handicap cannot be calculated. Where 5 differentials are available, the lowest differential is used as the average. Where 6 or 7 differentials are available, the lowest 2 are averaged. Where 8 or 9 differentials are available, the lowest 3 differentials are averaged. Where 10 or 11 differential are available, the lowest 4 differentials are averaged. Where 12 or 13 differentials are available, the lowest 5 are averaged. Where 14 or 15 are available, the lowest 6 are averaged. Where 16 or 17 are available, the lowest 7 are averaged. Where 18 are available, the lowest 8 are averaged. Where 19 are available, the lowest 9 are averaged.

The handicap is calculated by a handicap software routine and then displayed in the location seen in FIG. 1. The handicap is calculated by taking the handicap index and multiplying it by the fraction of the course slope (136 in FIG. 1) divided by the average course slope 113. The result is then rounded to the nearest integer.

As seen in FIG. 1, a statistical result labeled "Consi" is a measure of the consistency of the golfer's scores is calculated and displayed. The consistency result is calculated by a consistency software routine as the standard deviation of the handicap differentials. That is, the consistency result is equal to the square root of $((sds-sd\times sd/n)/(n-1))$, where sds=the sum of the handicap differential squares; sd=sum of the handicap differentials; and n=the number of handicap differentials.

A display software routine responds to the pressing of the forward (Fwd) and backward (Bwd) keys. The software routine increments or decrements the pointer addressing the record that is currently being displayed by the display 60. The routine then updates the display to include the information held in the currently addressed record. For example, where the twentieth record record is currently being displayed, and the golfer pushes the backward key, the pointer will be decremented to nineteen and the LCD display refreshed with data from the fields of the nineteenth record of the database.

A competition handicap software routine allows the rapid calculation of the golfer's course handicap when needed for competition. The course handicap is a number handicap strokes a player receives playing a specific course and tees. The software routine accesses the handicap index field in the most current record available in the database. The routine then prompts the user for the course slope by moving the cursor to the slope location (seen under "Entries" in FIG. 1). After the user input that information and pushes the "=" key, the competition handicap software routine then divides the handicap index by the course slope and displays the result in the handicap location (seen under "Statistics" in FIG. 1). The user then presses escape (Esc) to exit the software routine. The current record will then be displayed.

A software routine allows the user to delete a game and its associated record from the database. Where the microcontroller detects the delete key, the software waits for either the "=" key or the escape key. Where the "=" is pressed, the record currently displayed by the LCD is deleted. Records subsequent to the deleted record, if any, are renumbered. The statistics for the remaining records are then recalculated, beginning with the first record. The handicap index, handicap, consistency statistic and game rank for each game is recalculated. The highest game, lowest game and each game's rank are also recalculated.

The previously described versions of the present invention have many advantages, including a primary advantage of providing a novel golf calculator which performs data input, statistic calculation and data output functionality, and particularly which provides a convenient means for a golfer to obtain handicap information.

Another advantage of the present invention is to provide a golf calculator which performs statistical calculations resulting in the output of data reflecting the consistency of the golfer's performance.

A still further advantage of the present invention is to provide a golf calculator which defines a user interface having distinctive characteristics which aid in the rapid input, manipulation and display of data.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while several preferred keypad and display layouts have been disclosed, it is clear that some manipulation of the arrangement of these features would result in a further example of the golf calculator according to the teachings of the invention. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A golf calculator, comprising:

(A) microcontroller means, attached to random access memory and read-only memory, for performing data input, data storage of at least five game data records and statistical calculation functionality;

(B) keypad input means, connected to the microcontroller, for transferring data to the microcontroller;

(C) a display, driven by the microcontroller, for outputting alpha-numeric data;

(D) handicap differential software routine means, executed by the microcontroller, for the calculation of the handicap differential;

(E) handicap index software routine means, executed by the microcontroller, for the calculation and display of the handicap index;

(F) handicap software routine means, executed by the microcontroller, for the calculation and display of the handicap;

(G) consistency software routine means, executed by the microcontroller, for the calculation and display of consistency statistic; and (H) display software routine means, executed by the microcontroller, for the sequential display, upon input from a forward or a backward key, of the at least five game data records.

* * * * *